US008360262B2

(12) United States Patent
Vovan

(10) Patent No.: US 8,360,262 B2
(45) Date of Patent: Jan. 29, 2013

(54) INTEGRATED FOOD PACKAGING SYSTEM HAVING A CUP, A CONTAINER, AND A COVER

(75) Inventor: Terry Vovan, Upland, CA (US)

(73) Assignee: Pactiv Packaging Inc., Lake Forest, IL (US)

( * ) Notice: Subject to any disclaimer, the term of this patent is extended or adjusted under 35 U.S.C. 154(b) by 1225 days.

(21) Appl. No.: 12/220,017

(22) Filed: Jul. 21, 2008

(65) Prior Publication Data

US 2008/0277397 A1 Nov. 13, 2008

Related U.S. Application Data

(63) Continuation-in-part of application No. 11/315,654, filed on Dec. 21, 2005.

(60) Provisional application No. 61/065,561, filed on Feb. 13, 2008, provisional application No. 61/062,424, filed on Jan. 25, 2008.

(51) Int. Cl.
*B65D 25/04* (2006.01)
*B65D 43/16* (2006.01)
*B65D 41/32* (2006.01)

(52) U.S. Cl. ..... 220/522; 220/839; 220/266

(58) Field of Classification Search ..... 220/522, 220/266, 270, 4.23, 527, 520, 709, 705, 713, 220/797, 798, 574, 521, 839
See application file for complete search history.

(56) References Cited

U.S. PATENT DOCUMENTS 1,988,280 A 1/1935 Levkoff
2,567,013 A * 9/1951 Feinberg ..... 431/177
2,701,053 A 2/1955 Tamarin
3,572,579 A 3/1971 Mueller
3,773,207 A 11/1973 Dokoupil et al.
3,860,148 A 1/1975 Sherin
3,933,296 A 1/1976 Ruskin et al.
3,941,248 A 3/1976 Moser et al.
3,955,742 A 5/1976 Marshall et al.
3,984,025 A 10/1976 Khoury
4,060,176 A 11/1977 Tobiasson
4,113,136 A 9/1978 Abbott
4,139,121 A 2/1979 Roccaforte
4,262,814 A 4/1981 Roccaforte
(Continued)

FOREIGN PATENT DOCUMENTS

DE 7816353 11/1978
DE 4418935 12/1995
(Continued)

OTHER PUBLICATIONS

U.S. Appl. No. 11/315,654, filed Dec. 21, 2005.
(Continued)

*Primary Examiner* — Robin Hylton
(74) *Attorney, Agent, or Firm* — Baker Botts L.L.P.

(57) ABSTRACT

A food container formed of a single sheet of plastic, which includes a cup (12), a cover (16) that is movable between open and closed positions on the cup top, and a container (20,22) that is movable between a stowed position in the cup and an unstowed position out of the cup. The cup has a cup flange (34) and the container has a container flange (60) that is pivotally connected to the cup flange along a pivot line (64) that can be torn to separate the container from the cup. The cover is pivotally connected to the cup top at the cover flange, and the container has a lift tab (220) that lies on the cover flange. The container has a side wall that forms a vertical channel (190) on its outside for passing a straw into liquid in the cup.

22 Claims, 22 Drawing Sheets

U.S. PATENT DOCUMENTS

| | | | | |
|---|---|---|---|---|
| 4,520,943 | A | 6/1985 | Nielsen | |
| 4,555,043 | A | 11/1985 | Bernhardt | |
| 4,560,082 | A | 12/1985 | Sutch | |
| 4,569,443 | A | 2/1986 | Roccaforte | |
| 4,610,371 | A | 9/1986 | Karkiewicz | |
| 4,627,550 | A | 12/1986 | Dines | |
| 4,671,453 | A | 6/1987 | Cassidy | |
| 4,721,210 | A | 1/1988 | Lawrence et al. | |
| 4,742,935 | A | 5/1988 | Schellenberg | |
| 4,782,977 | A | 11/1988 | Watanabe et al. | |
| 4,785,963 | A | 11/1988 | Magley | |
| 4,819,824 | A | 4/1989 | Longbottom et al. | |
| 4,881,656 | A | 11/1989 | Chumley et al. | |
| 4,930,656 | A | 6/1990 | Blanchette | |
| 4,966,292 | A | 10/1990 | Marino et al. | |
| 4,974,735 | A | 12/1990 | Newell | |
| 4,990,345 | A | 2/1991 | Webb | |
| 5,002,198 | A | 3/1991 | Smith | |
| 5,007,231 | A | 4/1991 | Ingemann | |
| 5,027,969 | A | 7/1991 | Lesquir | |
| 5,040,695 | A | 8/1991 | Adams et al. | |
| 5,052,572 | A | 10/1991 | Pherigo | |
| 5,092,479 | A | 3/1992 | Wells | |
| 5,111,953 | A | 5/1992 | Faust et al. | |
| 5,111,954 | A | 5/1992 | Gaudreault | |
| 5,115,934 | A | 5/1992 | Nelson | |
| 5,129,531 | A | 7/1992 | Beck et al. | |
| 5,131,551 | A | 7/1992 | Wells | |
| 5,133,470 | A | 7/1992 | Abrams et al. | |
| 5,163,575 | A | 11/1992 | Luch et al. | |
| 5,170,905 | A | 12/1992 | Luch | |
| 5,219,087 | A | 6/1993 | Christensson | |
| 5,249,694 | A | 10/1993 | Nelson | |
| 5,251,758 | A | 10/1993 | Kolacek | |
| 5,283,940 | A | 2/1994 | Luch et al. | |
| 5,300,748 | A | 4/1994 | Colombo | |
| 5,303,839 | A | 4/1994 | Blumenschein | |
| 5,307,948 | A | 5/1994 | Blackburn et al. | |
| 5,437,386 | A | 8/1995 | Von Holdt | |
| 5,507,406 | A | 4/1996 | Urciuoli | |
| 5,511,679 | A | 4/1996 | Beck | |
| 5,528,814 | A | 6/1996 | Luch et al. | |
| 5,573,134 | A | 11/1996 | Chenault et al. | |
| 5,626,251 | A | 5/1997 | Luburic et al. | |
| 5,772,110 | A | 6/1998 | Garretson | |
| 5,785,203 | A | 7/1998 | Arshinoff et al. | |
| 5,788,105 | A | 8/1998 | Foos | |
| 5,871,147 | A | 2/1999 | Smith et al. | |
| 5,875,913 | A | 3/1999 | Letica | |
| 5,890,648 | A | 4/1999 | Cai | |
| 5,931,291 | A | 8/1999 | Sedon et al. | |
| 5,931,332 | A | 8/1999 | Mygatt et al. | |
| 5,979,690 | A | 11/1999 | Hartley | |
| 6,000,570 | A | 12/1999 | Nelson | |
| 6,045,038 | A | 4/2000 | Smith et al. | |
| RE36,729 | E | 6/2000 | Luch et al. | |
| 6,076,698 | A * | 6/2000 | Magidson | 220/520 |
| 6,116,450 | A | 9/2000 | Huang | |
| 6,193,921 | B1 | 2/2001 | Nelson | |
| 6,257,435 | B1 | 7/2001 | Chedister et al. | |
| 6,279,774 | B1 | 8/2001 | Clute et al. | |
| 6,328,355 | B1 | 12/2001 | Bortz | |
| 6,491,164 | B1 | 12/2002 | Virvo | |
| 6,572,909 | B1 | 6/2003 | Bagwell et al. | |
| 6,604,645 | B1 | 8/2003 | Vaupotic | |
| 6,604,646 | B2 | 8/2003 | Di Mario et al. | |
| 6,877,631 | B1 | 4/2005 | Thompson et al. | |
| 6,899,245 | B1 | 5/2005 | Nelson | |
| 7,004,314 | B2 | 2/2006 | Pucillo et al. | |
| 7,073,680 | B2 | 7/2006 | Boback et al. | |
| 7,097,043 | B2 | 8/2006 | Hsu | |
| 7,118,003 | B2 * | 10/2006 | Sellari et al. | 220/266 |
| 7,140,211 | B2 | 11/2006 | Tremblay | |
| 7,172,109 | B2 | 2/2007 | Kuenstler et al. | |
| 7,235,207 | B2 | 6/2007 | Gregory et al. | |
| 7,311,218 | B2 | 12/2007 | Varadarajan | |
| 7,325,676 | B2 | 2/2008 | Galaz | |
| 7,661,547 | B2 | 2/2010 | Richir | |
| 7,694,837 | B2 | 4/2010 | Robertson et al. | |
| 7,757,848 | B2 | 7/2010 | Gelardi et al. | |
| 2002/0088814 | A1 | 7/2002 | Belfance | |
| 2002/0170914 | A1 | 11/2002 | Witt | |
| 2003/0029868 | A1 | 2/2003 | Davidov et al. | |
| 2003/0127419 | A1 | 7/2003 | Shenkar et al. | |
| 2003/0160051 | A1 | 8/2003 | Ciccone | |
| 2003/0189048 | A1 | 10/2003 | Luburic | |
| 2004/0026286 | A1 | 2/2004 | Ramsey | |
| 2004/0045867 | A1 | 3/2004 | Appelbaum | |
| 2004/0094548 | A1 | 5/2004 | Laveault | |
| 2004/0108370 | A1 | 6/2004 | Lee | |
| 2004/0118848 | A1 | 6/2004 | Marshall | |
| 2004/0200839 | A1 | 10/2004 | Conti | |
| 2004/0200891 | A1 | 10/2004 | Correll | |
| 2005/0017007 | A1 | 1/2005 | Sellari et al. | |
| 2005/0061861 | A1 | 3/2005 | Pennino | |
| 2005/0145628 | A1 | 7/2005 | Schwarz | |
| 2005/0161455 | A1 | 7/2005 | Studee | |
| 2005/0173435 | A1 | 8/2005 | Wellman et al. | |
| 2005/0184070 | A1 | 8/2005 | Boback et al. | |
| 2005/0236413 | A1 | 10/2005 | Maciag et al. | |
| 2005/0252916 | A1 | 11/2005 | Varadarajan | |
| 2006/0003879 | A1 | 1/2006 | Buchman | |
| 2006/0006178 | A1 | 1/2006 | Foldesi et al. | |
| 2006/0011632 | A1 | 1/2006 | Caille | |
| 2006/0016821 | A1 | 1/2006 | Liu | |
| 2006/0144874 | A1 | 7/2006 | Solowiejko | |
| 2006/0163265 | A1 | 7/2006 | De Candido | |
| 2006/0201946 | A1 | 9/2006 | Witt | |
| 2006/0261070 | A1 | 11/2006 | Robertson et al. | |
| 2006/0266750 | A1 | 11/2006 | Lesquir | |
| 2006/0289541 | A1 | 12/2006 | Boback et al. | |
| 2006/0289549 | A1 | 12/2006 | Vovan | |
| 2007/0062948 | A1 | 3/2007 | Albrecht et al. | |
| 2007/0095848 | A1 | 5/2007 | Galland et al. | |
| 2007/0108210 | A1 | 5/2007 | Alvares et al. | |
| 2007/0138180 | A1 | 6/2007 | Vovan | |
| 2007/0164026 | A1 | 7/2007 | Morrissey et al. | |
| 2007/0202221 | A1 | 8/2007 | Hinze et al. | |
| 2008/0000904 | A1 | 1/2008 | Vovan | |
| 2008/0006632 | A1 | 1/2008 | Vovan | |
| 2008/0185383 | A1 | 8/2008 | Philippe et al. | |
| 2008/0199108 | A1 | 8/2008 | Rogers | |
| 2009/0021026 | A1 | 1/2009 | Collier | |
| 2009/0032545 | A1 | 2/2009 | Zeiler et al. | |
| 2009/0057313 | A1 | 3/2009 | Alvares | |
| 2009/0120936 | A1 | 5/2009 | Zauser et al. | |
| 2009/0120942 | A1 | 5/2009 | Vovan | |

FOREIGN PATENT DOCUMENTS

| | | |
|---|---|---|
| DE | 29819718 | 1/1999 |
| DE | 29914659 | 8/1999 |
| EP | 0752374 | 1/1997 |
| EP | 1736417 A1 | 12/2006 |
| FR | 2691952 | 12/1993 |
| FR | 2 819 496 | 7/2002 |
| GB | 2257118 | 1/1993 |
| WO | WO 2005/082733 | 9/2005 |
| WO | WO 2005/082734 | 9/2005 |

OTHER PUBLICATIONS

U.S. Appl. No. 11/879,168, filed Jul. 16, 2007.

U.S. Appl. No. 11/857,144, filed Sep. 18, 2007.

U.S. Appl. No. 11/315,654, Non-Final Rejection dated Nov. 25, 2009.

U.S. Appl. No. 11/315,654, Amendment dated Jan. 20, 2010.

U.S. Appl. No. 11/315,654, Supplemental Response dated Feb. 23, 2010.

U.S. Appl. No. 11/315,654, Restriction Requirement dated Jun. 25, 2010.

U.S. Appl. No. 11/315,654, Response to Restriction Requirement dated Jul. 26, 2010.

U.S. Appl. No. 11/879,168, Non-Final Rejection dated Jun. 10, 2010.

U.S. Appl. No. 11/879,168, Amendment dated Sep. 14, 2010.

U.S. Appl. No. 12/432,627, filed Apr. 29, 2009.

U.S. Appl. No. 12/075,549, filed Mar. 12, 2008.

U.S. Appl. No. 12/327,759, filed Dec. 3, 2008.
U.S. Appl. No. 11/879,168, Apr. 26, 2011 Advisory Action.
U.S. Appl. No. 11/879,168, Mar. 10, 2011 Response to Final Office Action.
U.S. Appl. No. 11/879,168, Dec. 10, 2010 Final Office Action.
U.S. Appl. No. 11/857,144, Jan. 7, 2011 Non-Final Office Action.
U.S. Appl. No. 12/432,627, Apr. 15, 2011 Notice of Allowance.
U.S. Appl. No. 12/432,627, Mar. 25, 2011 Response to Final Office Action.
U.S. Appl. No. 12/432,627, Jan. 26, 2011 Final Office Action.
U.S. Appl. No. 12/432,627, Dec. 22, 2010 Response to Non-Final Office Action.
U.S. Appl. No. 12/432,627, Aug. 24, 2010 Non-Final Office Action.
U.S. Appl. No. 12/432,627, Aug. 9, 2010 Response to Restriction Requirement.
U.S. Appl. No. 12/432,627, Jul. 8, 2010 Restriction Requirement.
U.S. Appl. No. 12/327,759, Apr. 21, 2011 Response to Non-Final Office Action.
U.S. Appl. No. 12/327,759, Jan. 21, 2011 Non-Final Office Action.
U.S. Appl. No. 11/879,168, Jun. 27, 2011 Notice of Allowance.
U.S. Appl. No. 11/879,168, Jun. 10, 2011 Notice of Appeal.
U.S. Appl. No. 11/879,168, Jun. 9, 2011 Amendment after Final.
U.S. Appl. No. 11/857,144, Sep. 21, 2011 Response to Final Office Action.
U.S. Appl. No. 11/857,144, Jun. 21, 2011 Final Office Action.
U.S. Appl. No. 12/327,759, Aug. 11, 2011 Final Office Action.
U.S. Appl. No. 12/432,627, Jul. 29, 2011 Non-Final Office Action.
U.S. Appl. No. 12/432,627, Jul. 15, 2011 Amendment after Notice of Allowance and Request for Continued Examination (RCE).
U.S. Appl. No. 12/075,549, Jul. 22, 2011 Non-Final Office Action.

* cited by examiner

INTEGRATED FOOD PACKAGING SYSTEM HAVING A CUP, A CONTAINER, AND A COVER

CROSS-REFERENCE

Applicant claims priority from U.S. Provisional patent application Ser. No. 61/065,561 filed Feb. 13, 2008, U.S. Provisional patent application Ser. No. 61/062,424 filed Jan. 25, 2008, and U.S. patent application Ser. No. 11/973,779 filed Oct. 9, 2007. This is a continuation-in-part of U.S. patent application Ser. No. 11/315,654 filed Dec. 21, 2005.

BACKGROUND OF THE INVENTION

There are many foods that are best packaged separately but commonly eaten together. Some examples are French fries, ketchup, and salt; and apple pieces and yogurt. A food packaging system that packaged the foods separately in closed container(s) that lay in a tamper resistant cup which also held food, would be of value. It would be desirable if the container (s), the cup, and a cover were initially joined together, as with the parts of the combination formed of a single sheet of plastic. The sheet of plastic could join the parts together with pivot joints which connected the parts when being loaded with food and when later placed in a compact configuration. The loaded container could be stowed in the cup and the combination closed, by simply pivoting the container and cover to their closed positions at which they automatically hold tightly together to resist unauthorized access to any of the food as by a person who wants to taste the food before buying it.

SUMMARY OF THE INVENTION

In accordance with one embodiment of the present invention, a low cost food packaging system is provided that includes a cup that holds a first food, at least one container that lies right-side-up in the cup and holds another food, and a cover that closes the top of the cup while it holds the container. The cup, container, and cover are all formed of a single sheet of plastic, and each can be separated from the cup. The cup and cover each has a flange, and the cup and cover flanges are joined along a first pivot line that can be torn to separate the cup and cover. The container has a container flange that is joined to the cup flange about a second pivot line that is perpendicular to, or widely spaced from, the first pivot line, with the second pivot line also being capable of being easily torn to separate the container from the cup and cover.

The container has a main recess that holds the container food, and the container has a vertical channel in the outside of one of its side walls so a straw can be inserted into liquid in the cup without removing the container from the cup. The container forms a tab that projects further radially out than most of the container flange and that lies under the cover flange, and that can be used to lift the container.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
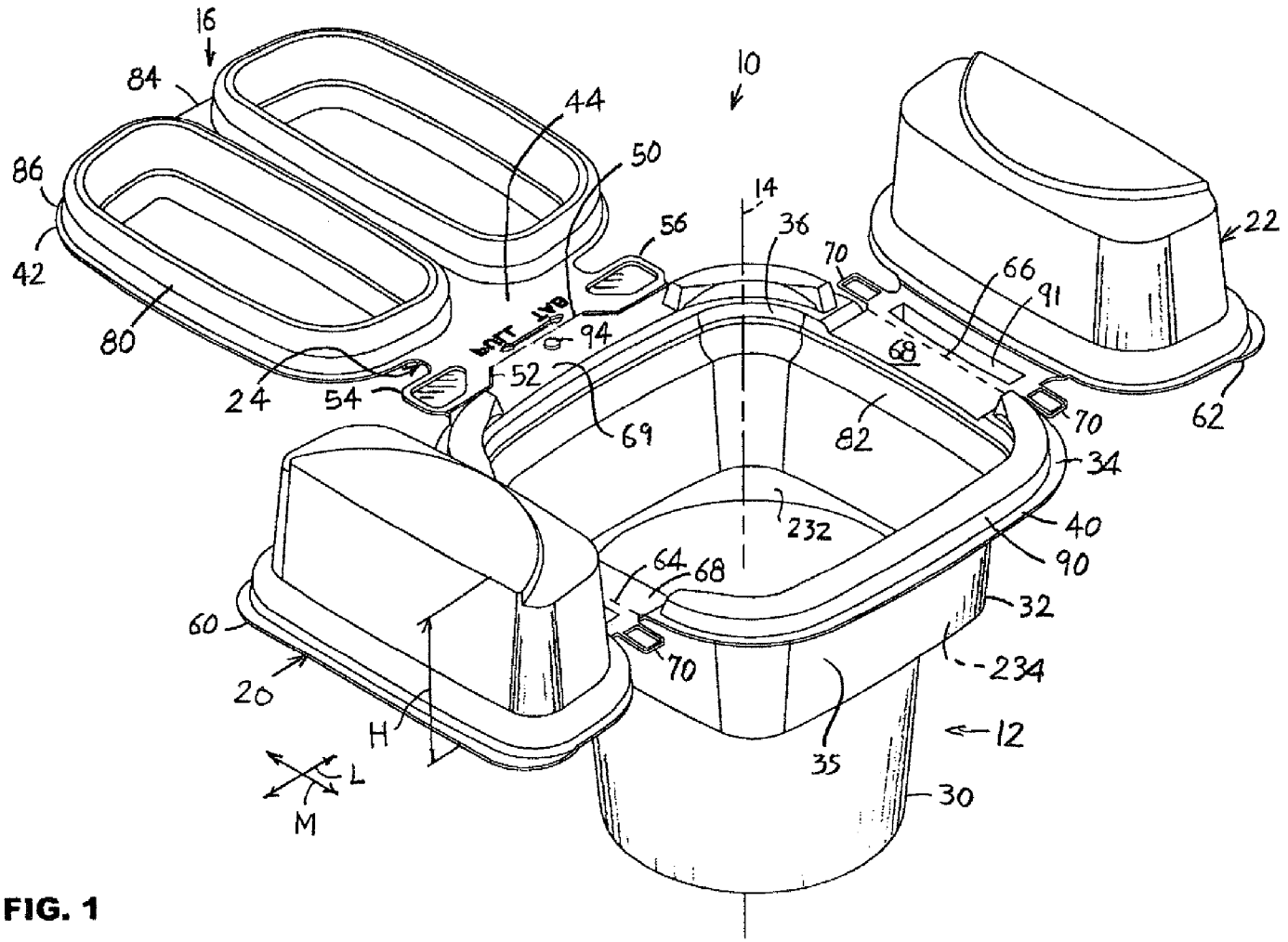
FIG. 1 is a top isometric view of a packaging system of a first embodiment of the present invention in the open, manufactured position, with the cover pivotally attached to the rear of the cup and the containers pivotally attached to opposite sides of the cup.
Figure 2:
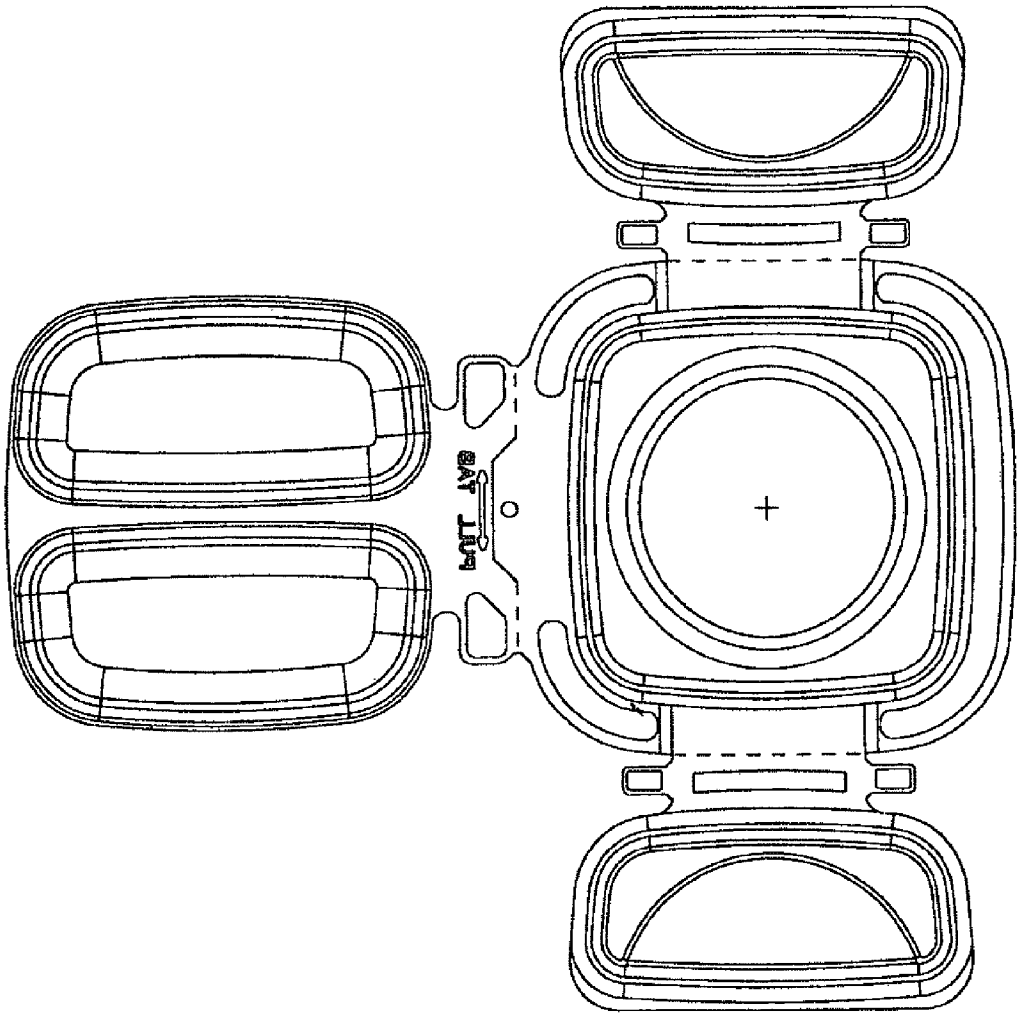
FIG. 2 is a plan view of the system of FIG. 1
Figure 3:
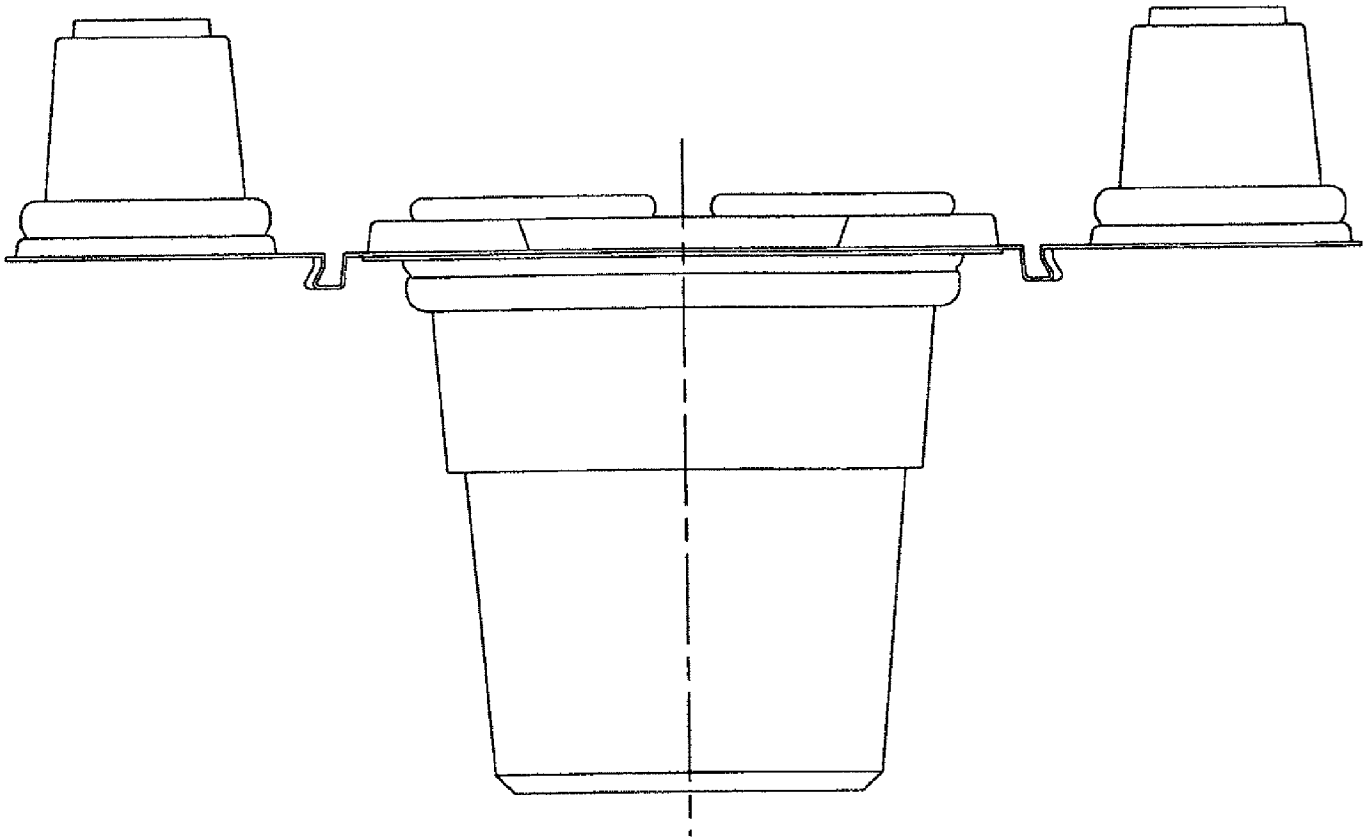
FIG. 3 is a front elevation view of the system of FIG. 1

FIG. 1 illustrates a packaging system 10 that can hold three different foods, such as French fries, ketchup, and salt. The packaging system or food holder, includes a cup 12 with a vertical axis 14, a cover 16, and left and right containers 20, 22. The container preferably have a storage height H of at least one centimeter, and are at least twice as tall as the cover. The system is illustrated in the configuration, or position that it occupies when manufactured, and in which multiple identical systems can be stacked. The system is usually manufactured from a single sheet 24 of transparent plastic, as by vacuum forming. The cup has a cup lower portion 30 that may hold a solid food such as French fries or a liquid food such as a cola, coffee, fruit juice or yogurt. The cup also has a cup upper portion 32 with a cup flange 34 that extends primarily radially outward (with respect to the axis 14) from the cup side wall 35 at the cup top 36, the flange forming a cup periphery 40.

The cover 16 has a cover flange 42 that is joined to the cup flange 34 at a cover joining region 44. The cover joining region includes a tearable pivot line 50 that extends in lateral L directions. The line 50 is shown as having spaced cuts to facilitate tearing. The cup and cover are already separated along separation lines 52 extending from the ends of the pivot line to the outside of the joining region. The joining region 44 also forms a pair of handles in the form of lift tabs 54, 56 at opposite sides of the joining region. Similarly, the containers 20, 22 each has a container flange 60, 62 at its periphery that is joined to the cup flange at a corresponding tearable pivot line 64, 66 extending in a longitudinal direction M that is perpendicular to the lateral direction L. The container flanges also form pairs of lift tabs 70.

The cup flange 34 has slight depressions in container joining region 68 that lead to the container pivot lines 64, 66, which locate such pivot lines below the level of part 69 of cover joining region 44. The amount of depression is about equal to the plastic material thickness of about 0.5 mm (between half and twice the thickness, or 0.25 mm to 1.0 mm). This avoids interference between the containers and covers in their closed positions.

Figure 20:
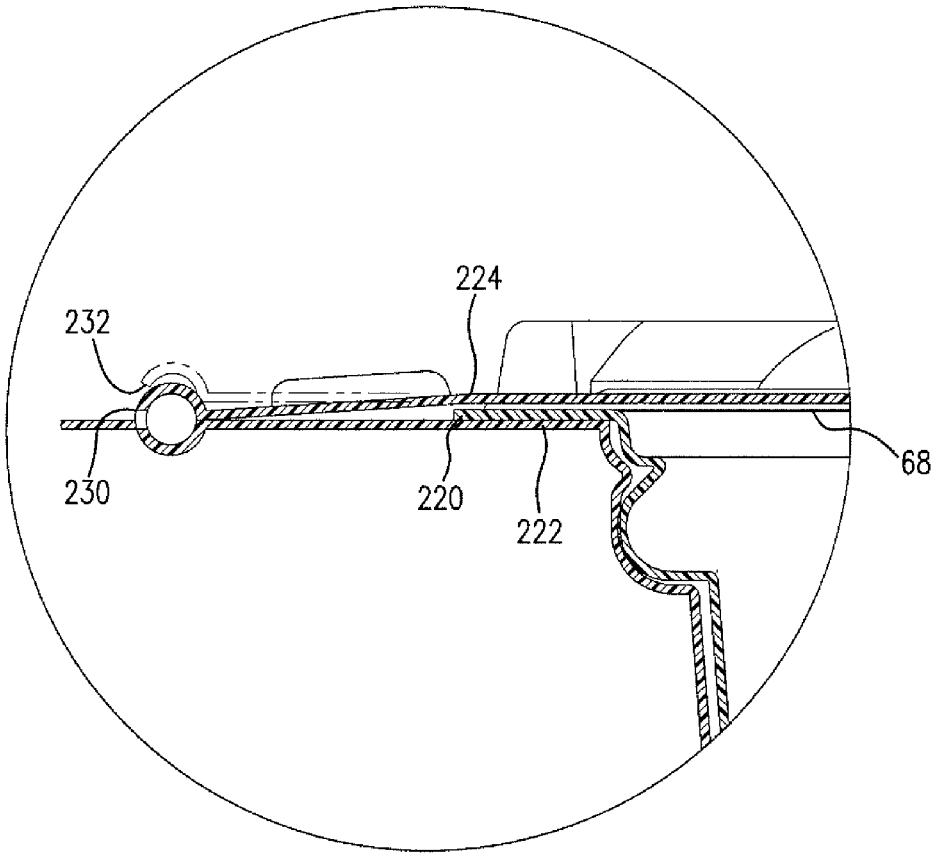
FIG. 20 is a sectional view of a portion of the container of FIG. 19.

After the food holder system of FIG. 1 is manufactured, as by vacuum forming a sheet of plastic, the cup lower portion 30 is filled with food. Then the containers 20, 22 are pivoted about pivot lines or axes 64, 66 to upright positions wherein they both lie stowed in the cup upper portion 32. Then the containers are filled with food. A lid film (e.g. 68 in FIG. 20) may or may not be applied over the containers to avoid spillage. Finally, the cover 16 is pivoted about its pivot line or axis 50 until it lies in the cup top 36. The cover has cover sealing surfaces 80 that seal to cup sealing surfaces 82 at the cup top. The sealing surfaces not only seal, but prevent lifting of the cover flange end 84 that lies opposite the joining region 44. The sealing surfaces are curved about a point 85 (FIG. 7) that lies on the axis 14. The cover flange has a cover peripheral edge 86.

Figure 4:
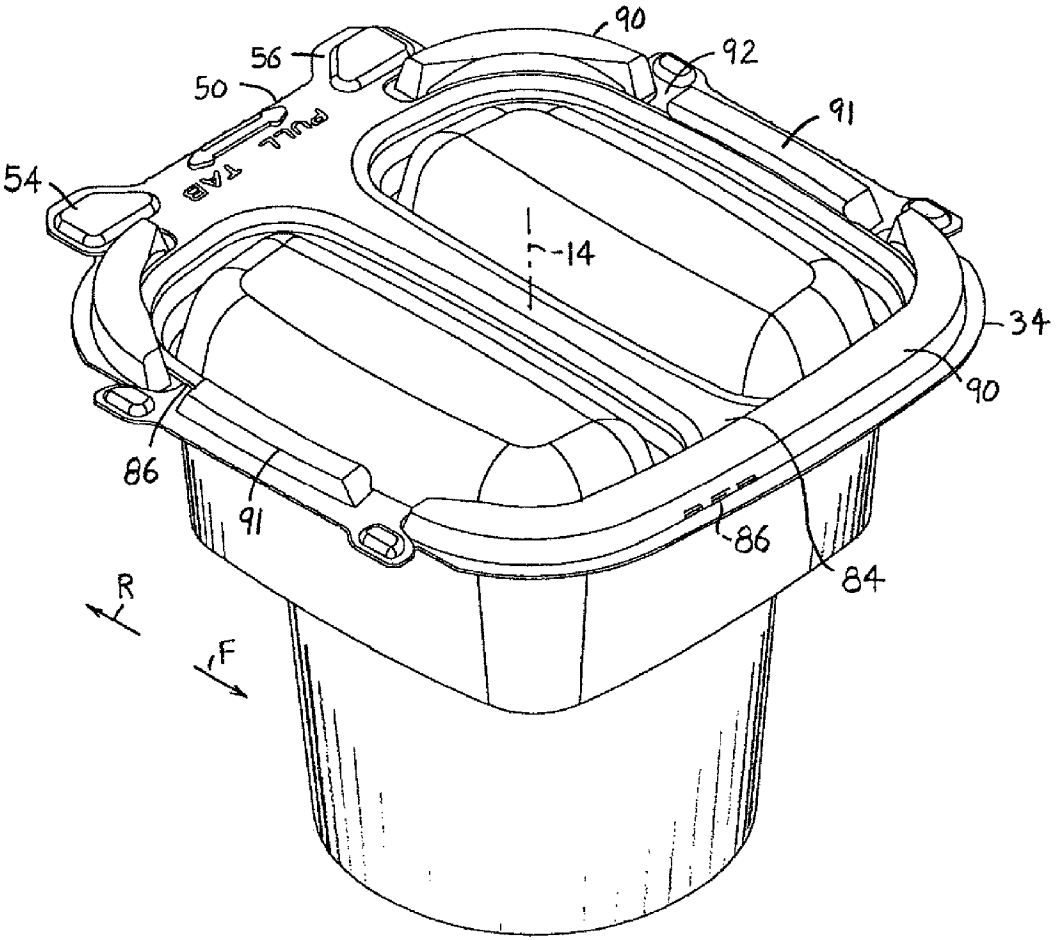
FIG. 4 is a top isometric view of the system of FIG. 1 but with the containers and cover lying in a stowed position, and ready for sale (assuming food has been loaded into the cup and container).
Figure 5:
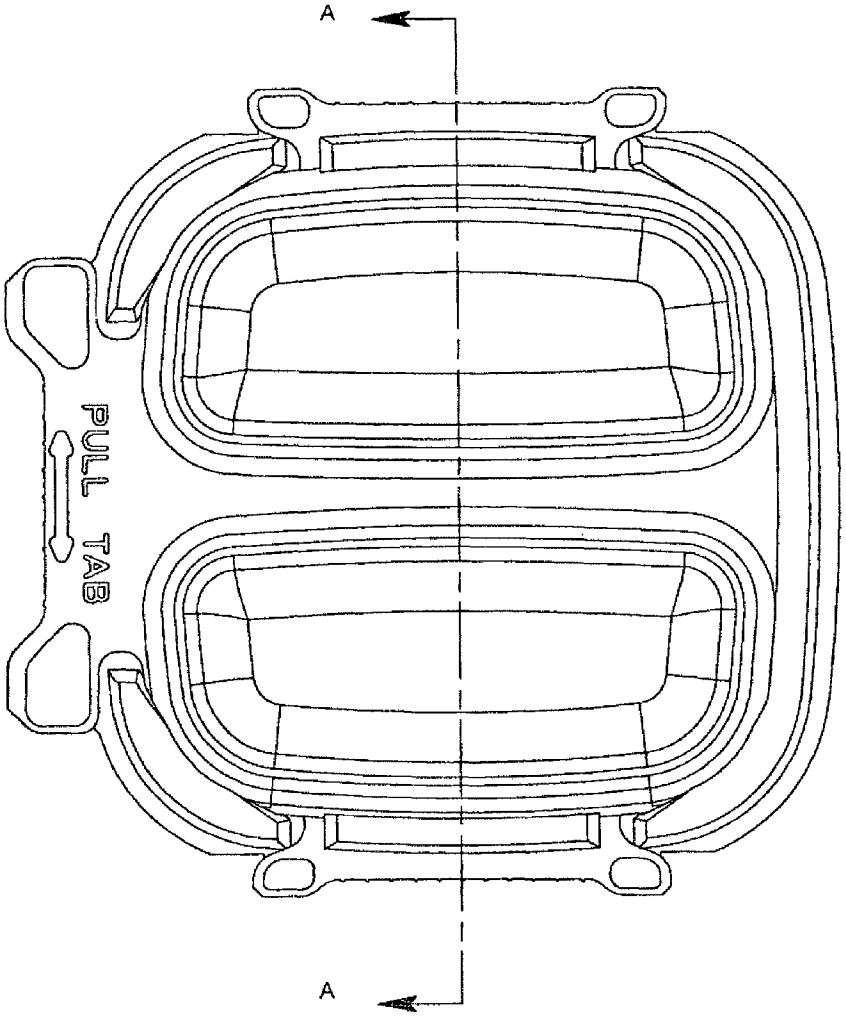
FIG. 5 is a plan view of the system of FIG. 4.

FIG. 4 shows the system in the closed position, with the cover end 84 at the cup front end 88. Front and rear directions are indicated by arrows F, R. The cup flange 34 has an upward protrusion 90 that extends around the periphery of the cup and that is supplemented by container protrusions 91. Interruptions 92 occupy less than half of the cup periphery. The cup and container protrusions 90, 91 block easy access to the cover edge 86. The cover edge 86 is exposed only in narrow areas 92 which are too narrow for a person to insert his/her finger tip into the area to lift the cover edge. To open the system, a person lifts one or both of the lift tabs 54, 56 to tear apart the cover from the cup along the tearable pivot line 50. Applicant provides an upward projection 94 (FIG. 1) that slightly separates the lift tabs 54, 56 from the cup flange to make it easier to grasp the tabs. After the cover is removed, the containers 20, 22 can be torn loose from the cup by lifting one or both lift tabs 70 for each container. It would be possible to keep the containers in the cup and eat out of them, but that make it difficult to access food in the cup lower portion.

Figure 6:
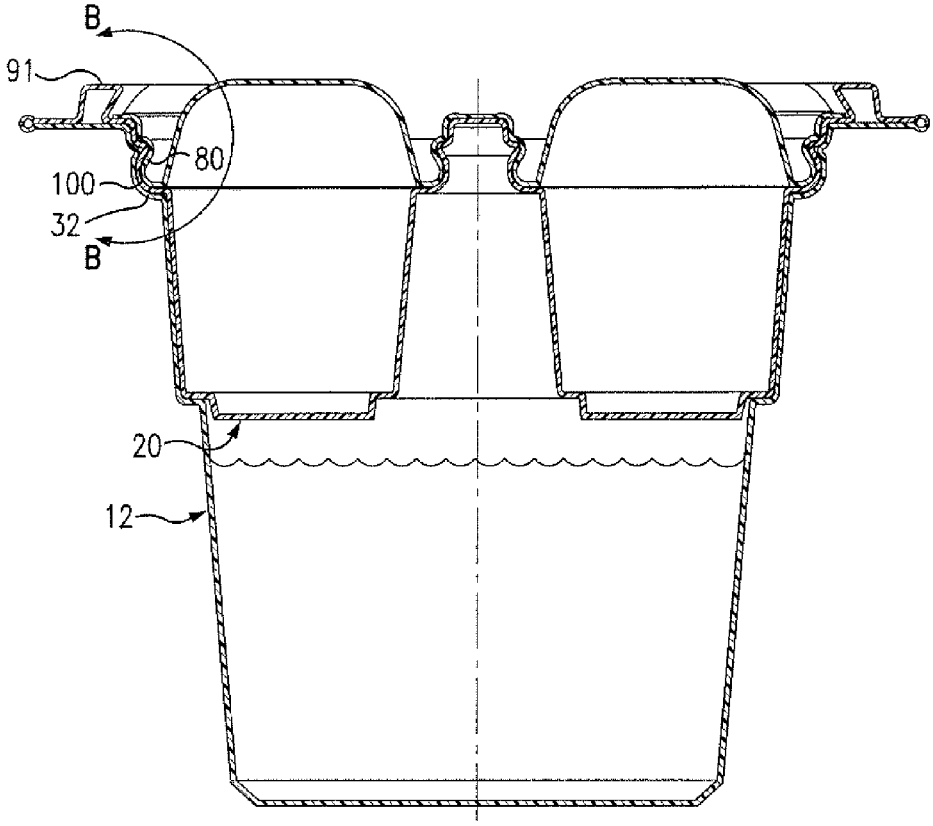
FIG. 6 is a sectional view taken on line A-A of FIG. 5.
Figure 7:
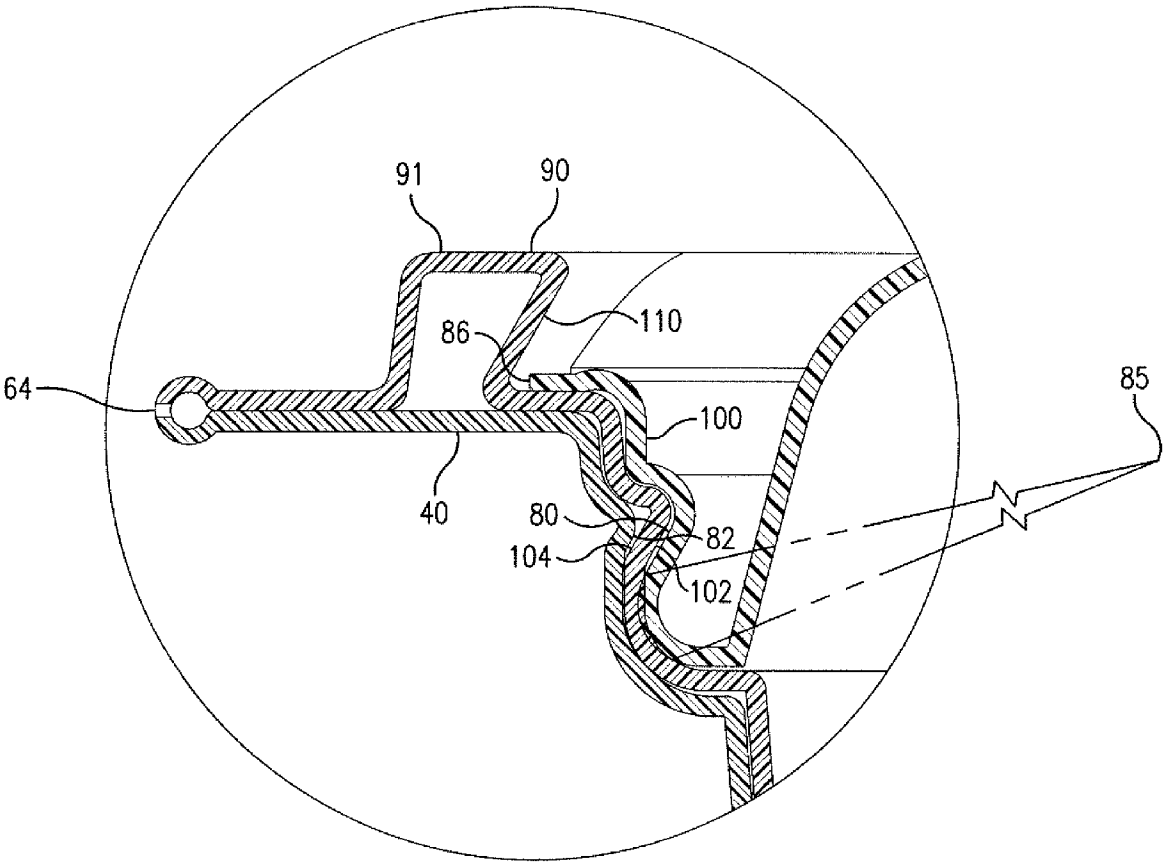
FIG. 7 is an enlarged view of area B-B of FIG. 6.
Figure 8:
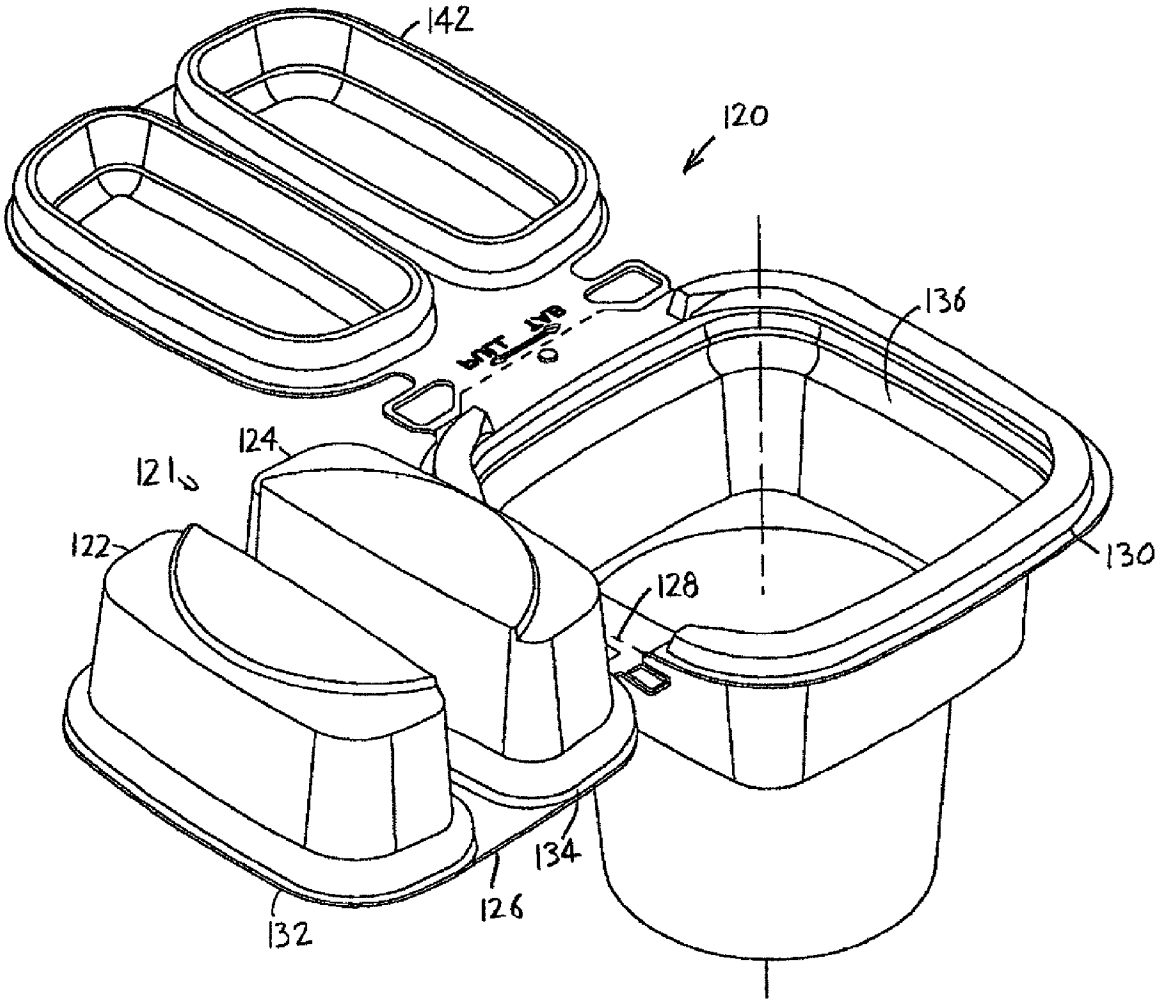
FIG. 8 is a top isometric view of a packaging system of a variation of the system of FIG. 1, which includes one double container in the open, manufactured position, the container being pivotally mounted to one side of the cup.
Figure 9:
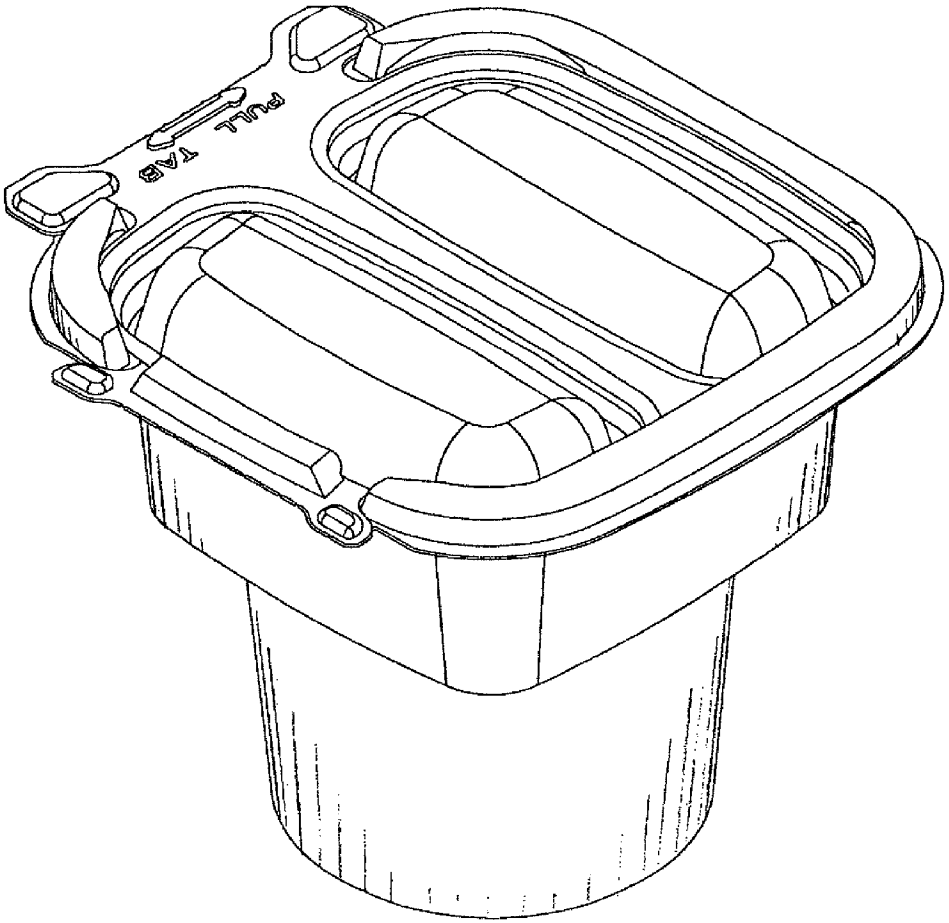
FIG. 9 is a top isometric view of the system of FIG. 8 in the closed or stowed position.
Figure 10:
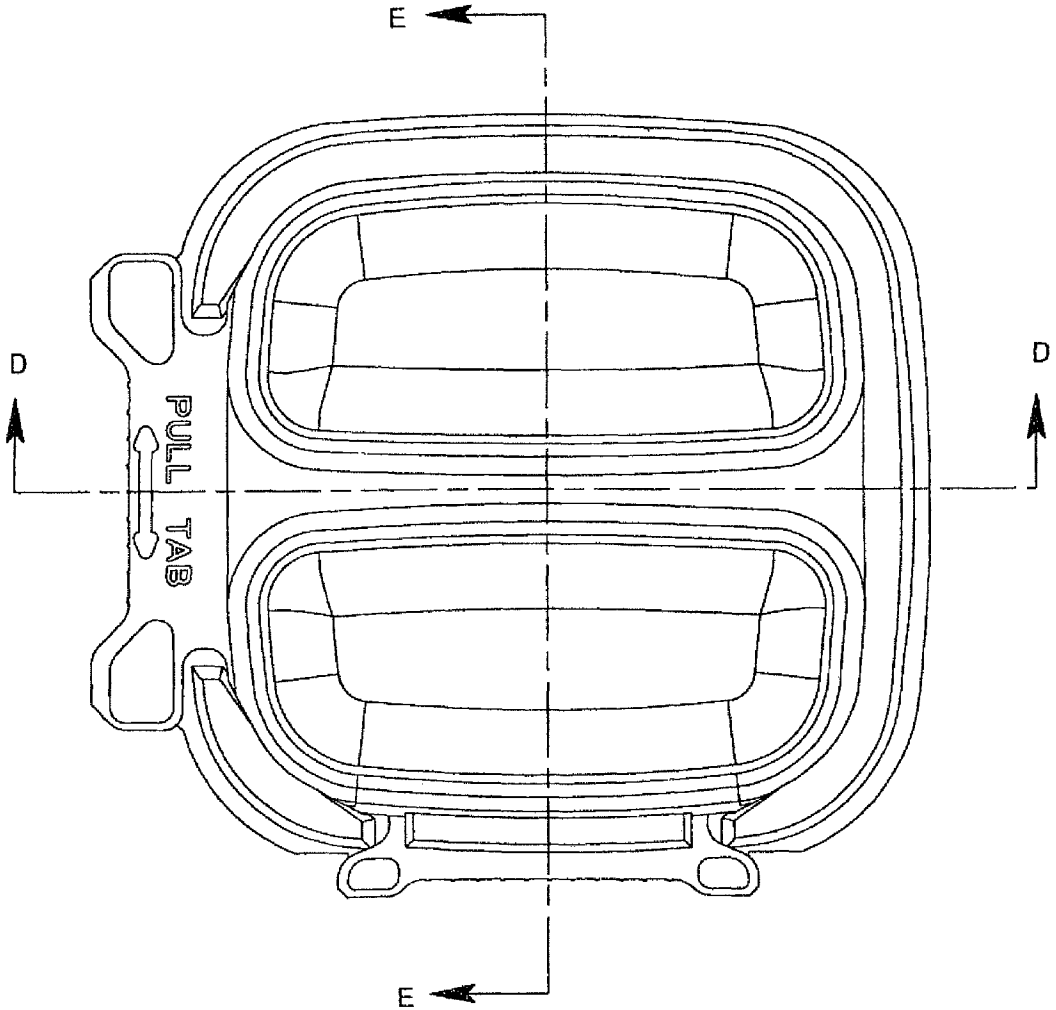
FIG. 10 is a plan view of the system of FIG. 9.
Figure 11:
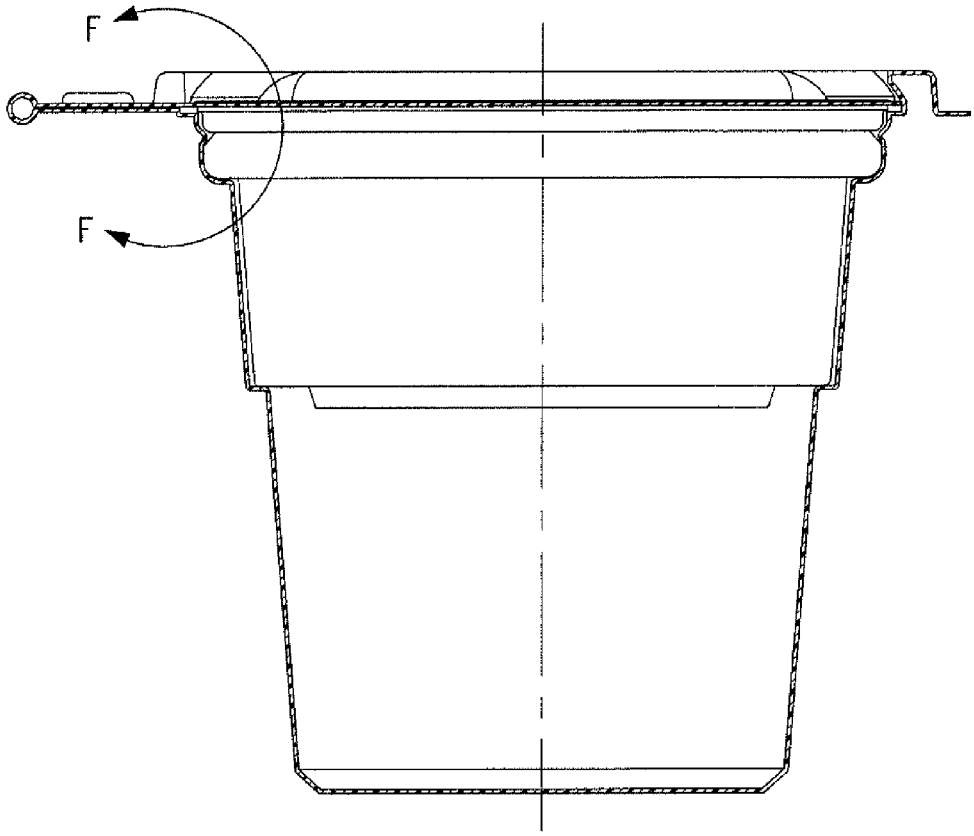
FIG. 11 is a sectional view taken on line D-D of FIG. 10.

FIG. 6 shows that the left container 20 has an upper portion 100 that lies between the cup upper portion 32 and the seal surface 80 of the cover. As shown in FIG. 7, the container upper portion 100 has radially (with respect to the cup axis) inner and outer seal surfaces 102, 104 that lie in an interference fit, respectively, with the cover sealing surface 80 and with the cup sealing surface 82. These interference fits not only provide good sealing to prevent inward and outward leakage into and out of the cup and container, but strongly resist upward lifting of the cover and container off the cup before the container is opened by a customer. FIG. 7 shows that the upward projections 90, 91 on the cup or container flange is upwardly vertically undercut, so if the cover edge 86 is moved up it will hit the inside wall 110 of the upward projection. Thus, even if a person should begin to lift the cover without tearing the cover away from the cup, the inside wall of the projection will resist such lifting. When the cover is torn loose, the cover lift tabs can provide sufficient force to lift the cover.

Figure 12:
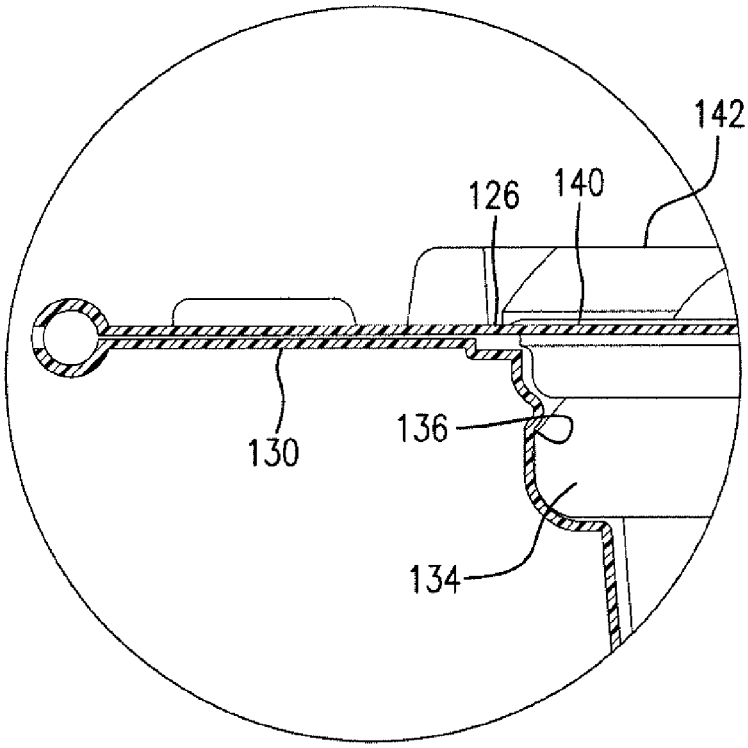
FIG. 12 is an enlarged view of area F-F of FIG. 11.
Figure 13:
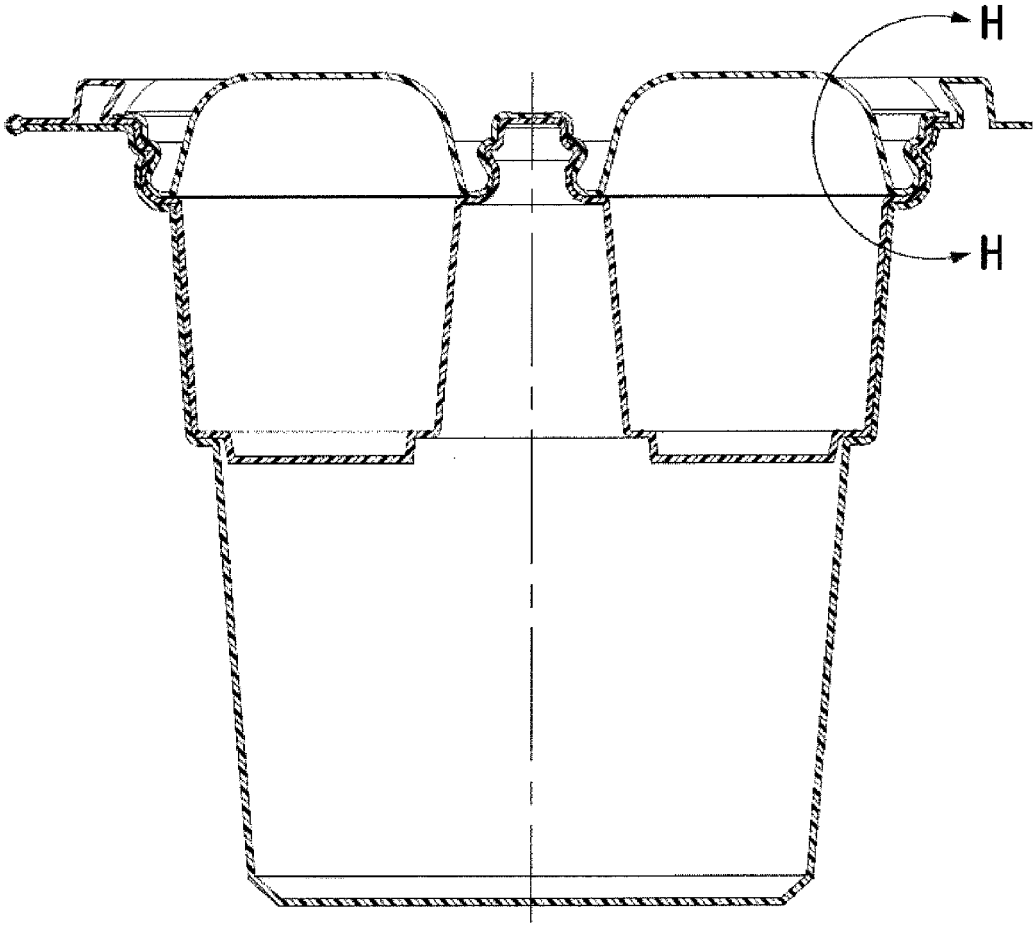
FIG. 13 is a sectional view taken on line E-E of FIG. 10.
Figure 14:
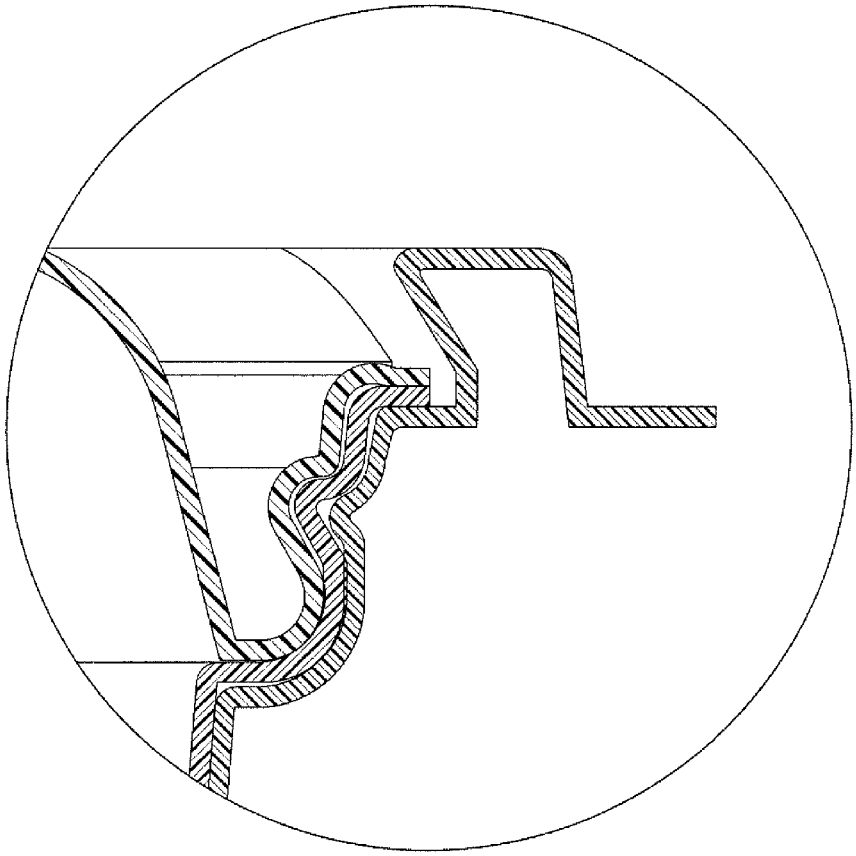
FIG. 14 is an enlarged view of area H-H of FIG. 13.

FIGS. 8-14 illustrate another system 120 in which the container 121 includes two containers, or container portions 122, 124 that are fixed together at a single flange 126 that is pivotally connected along a tearable pivot line 128 to the cup flange 130. Each container has a sealing surface 132, 134. As shown in FIG. 12, the container sealing surface 134 seals to a cup sealing surface 136. The top 140 of the container lies under the cover 142. A lidding film is usually placed on the top of the containers to seal them.

Figure 15:
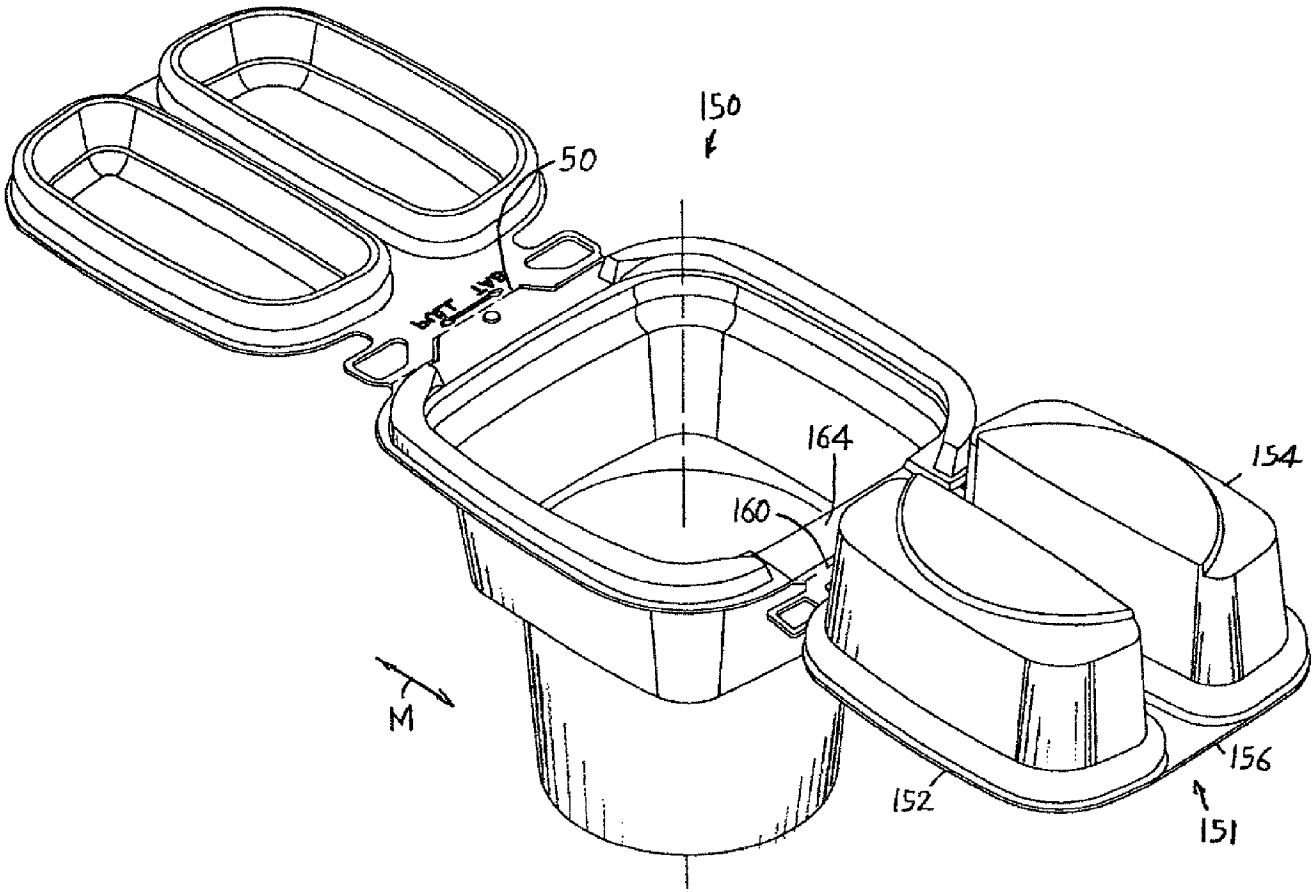
FIG. 15 is a top isometric view of a variation of the packaging system of FIG. 8, wherein a double container is pivotally connected to the front of the cup.
Figure 16:
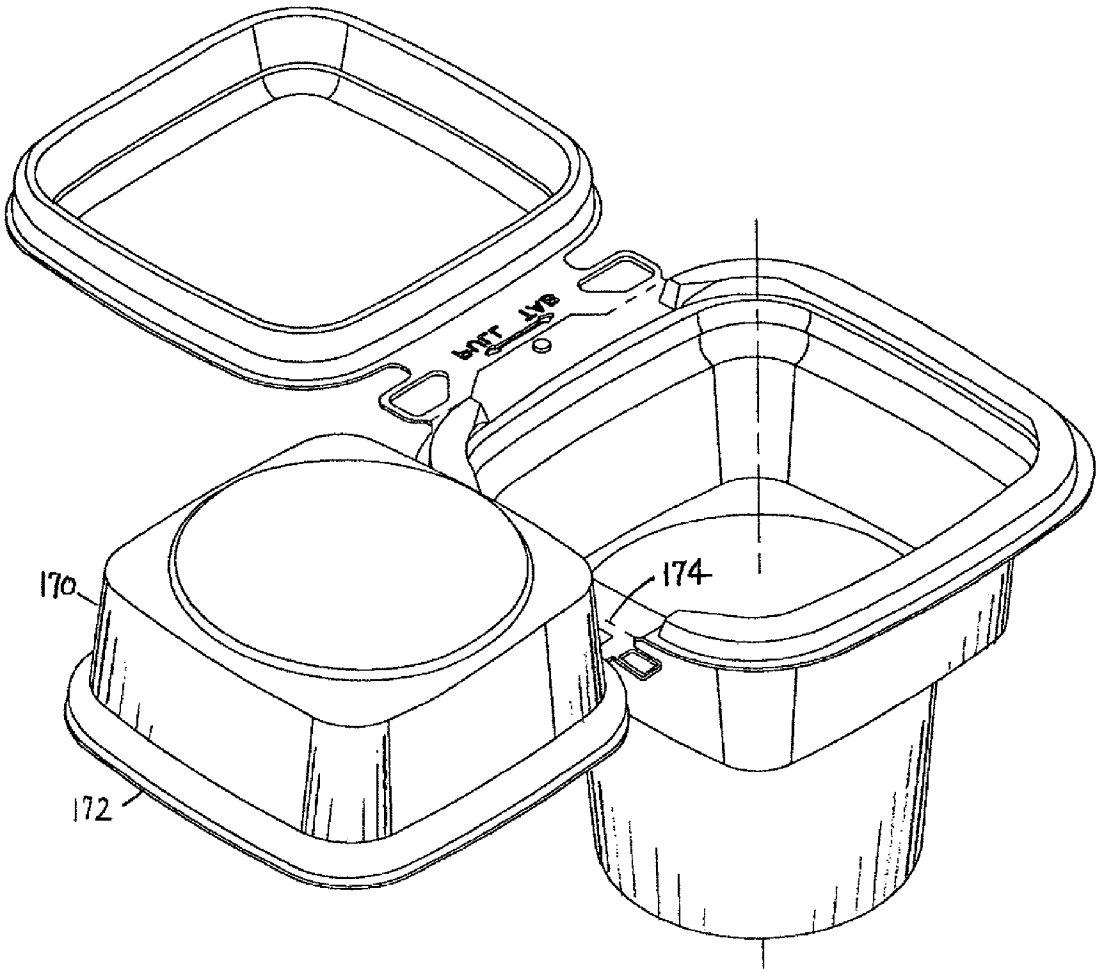
FIG. 16 is a top isometric view of a variation of the packaging system of FIG. 8, wherein a wide container is pivotally connected to a side of the cup.

FIG. 15 illustrates another system 150 wherein a container 151 includes two container portions 152, 154 fixed together at a single flange 156. The flange 156 is pivotally connected about a tearable pivot line 160 on the front end of the cup flange 164. The pivot lines 160, 50 about which the cover and container flange pivot are parallel but longitudinally M spaced. FIG. 16 shows a single container 170 with a flange 172 that is pivotally connected about a longitudinal line 174 to the cup flange.

Figure 17:
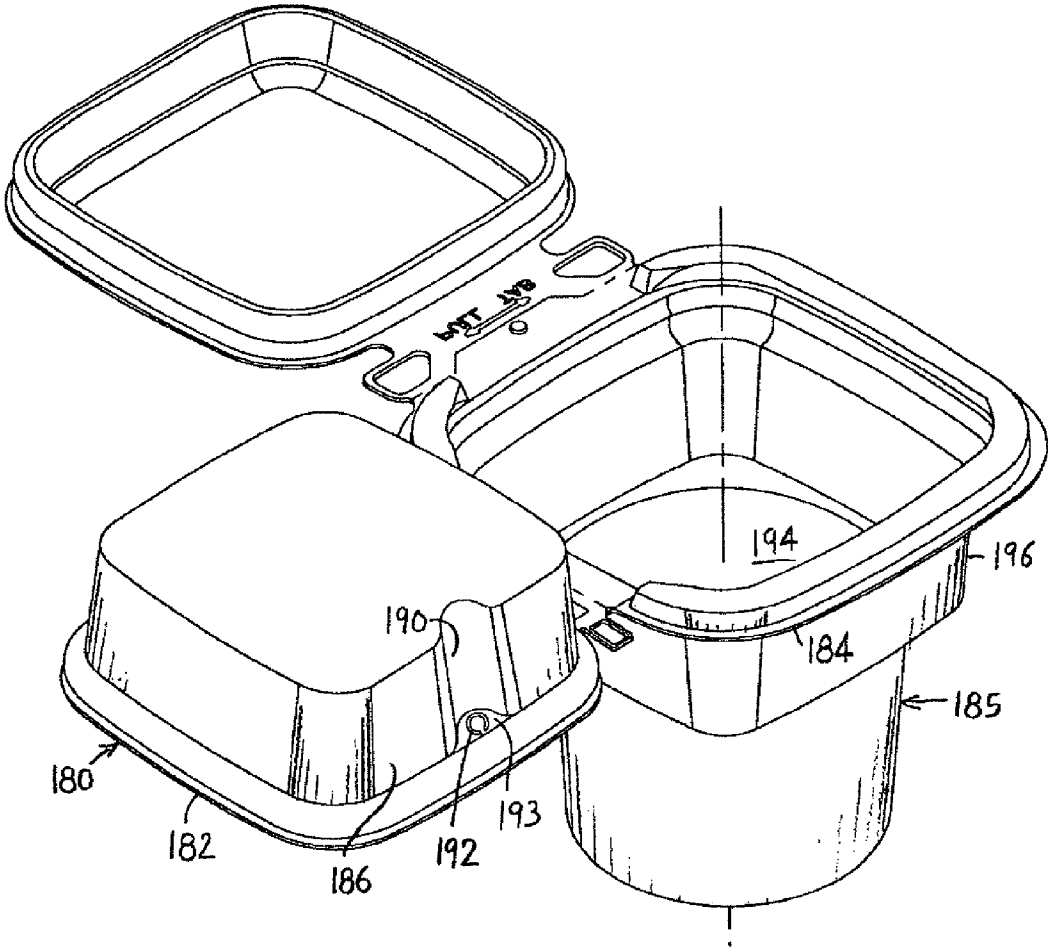
FIG. 17 is a top isometric view of a packaging system of another embodiment of the invention in the open, manufactured position, wherein the container forms a straw-receiving vertical channel
Figure 21:
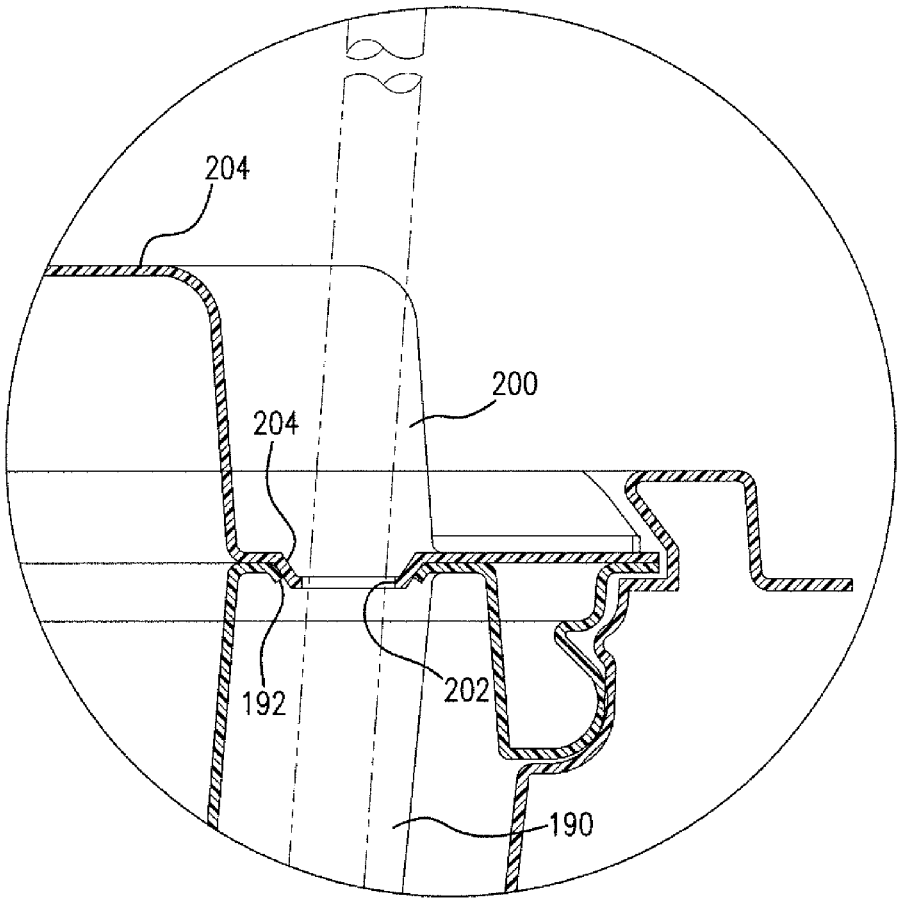
FIG. 21 is a sectional view of a system that is a variation of the system of FIG. 18.

FIG. 17 illustrates a system which includes a single container 180 with a container flange 182 that is pivotally connected to a cup flange 184 of a cup 185. The container has side walls 186 that form a vertical channel 190 on the outside of the container, that leads from the top of the container (in the right-side-up position of the container wherein the flange is uppermost) to the container bottom. A hole 192 in the top wall 193 of the container allows a straw to be inserted though the container and into the cup lower portion cavity 194, to allow a person to drink fluid (cola, fruit juice, coffee, etc.) from the cup lower portion, while the container lies stowed in the cup upper portion 196. FIG. 21 shows a similar channel 200 and hole 202 in the cover 204 to allow the fluid to be drunk from the cup lower portion without opening the cover. The cover hole 202 has conical walls 204 that tend to trap the straw in the holes if there is a slight interference fit between the straw and hole walls.

Figure 18:
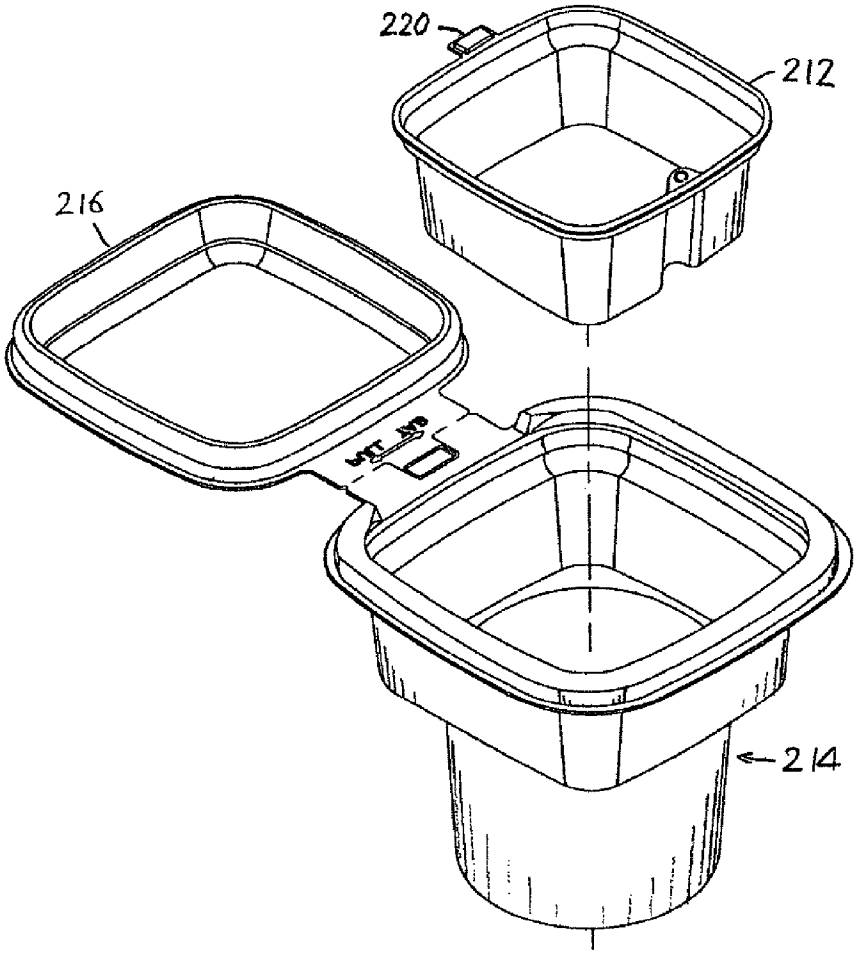
FIG. 18 is a top exploded view of a variation of the packaging system of FIG. 18, wherein the container is not integral with a sheet of plastic that forms the cup and cover, and the container has a lift tab and a straw-receiving channel.
Figure 19:
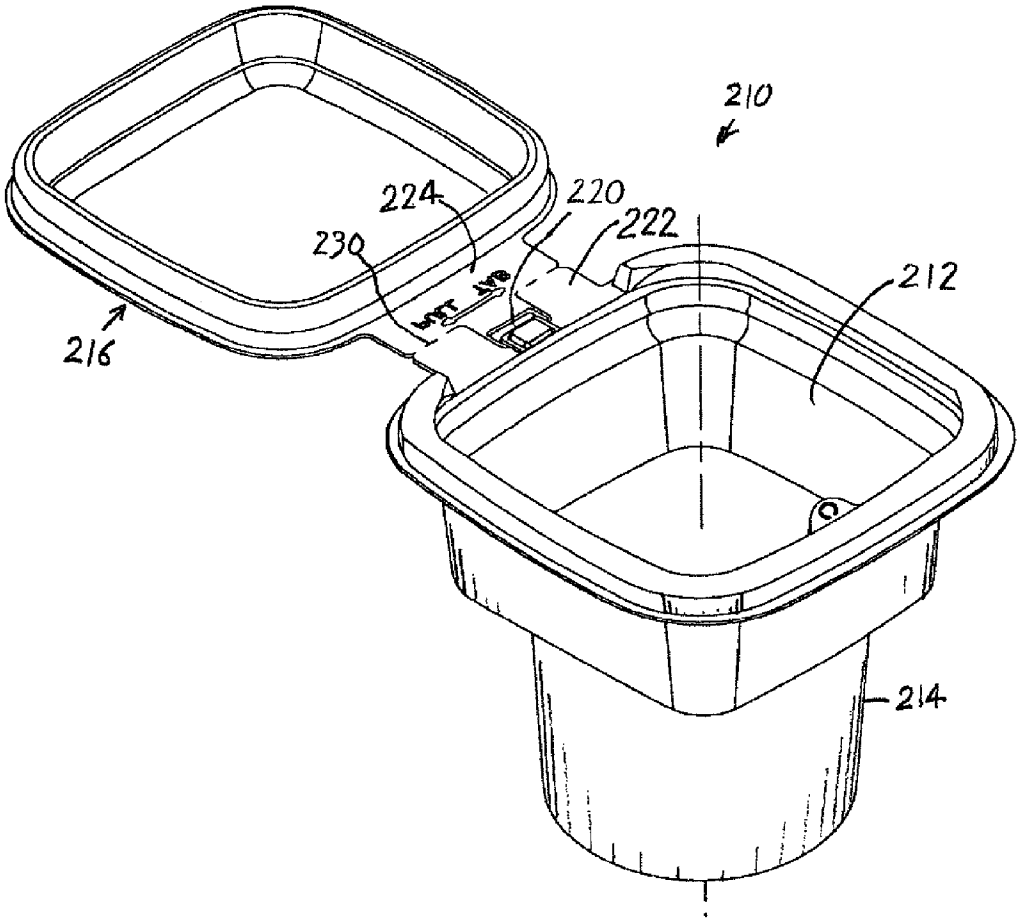
FIG. 19 is a top isometric view of the system of FIG. 18 with the container lying in the cup, and with the cover open, during the loading of food in the container.

The system of FIGS. 18 and 19 illustrates a system 210 that is similar to that of FIG. 17, except that the container 212 is formed from a sheet of plastic that is separate from a sheet that forms the cup 214 and cover 216. The container has a tab 220 that allows the container to be lifted up out of the cup upper portion. When the container lies in the cup as in FIG. 20, the tab 220 lies on the cup flange part 222 and under the cover flange part 224. The tab helps to separate the cup and cover flange parts 222, 224 to a person can more easily grasp the single central lift tab 220 that is lifted (or moved down) to tear the cover away from the cup along a tearable pivot line 230. After the cover has been torn free along line 230, and then the cover is replaced, the large gap at 232 caused by the tab 220, indicates the fact that the system has been opened. The gap also makes the cover easy to lift.

Figure 22:
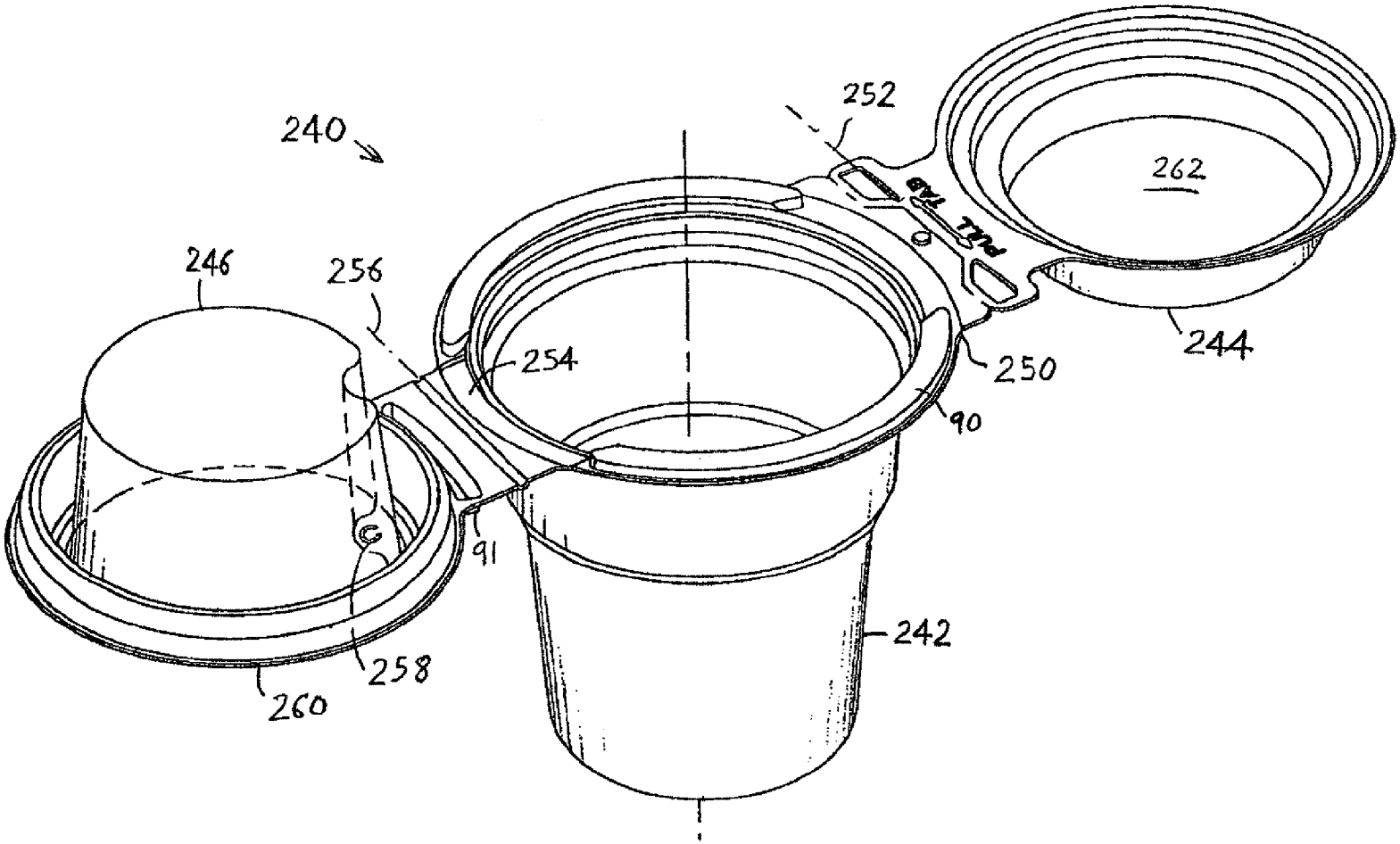
FIG. 22 is a top isometric view of a packaging system that is a variation of the system of FIG. 15.

FIG. 22 shows a system 240 in which the cup 242, cover 244, and container 246 have primarily round peripheries. The cover 244 is pivotally connected to a cup flange 250 at a pivot line 252 that is easily torn. The container 246 is pivotally connected to a depressed part 254 of the cup flange about a pivot line 256 that is not easily torn. Food in the container can be readily eaten without separating the container from the cup. In fact, food in the container can be eaten with the container lying stored in the cup, if food in the cup is liquid that can be consumed through a straw projected through a straw hole 258.

The container 246 is shown as opening upward when it lies stowed in the cup 242, and opening downward when pivoted outside the cup as shown in FIG. 22. The container has a peel-off lid film 260 over its open end. It is possible to have the container open upward in the position of FIG. 22. The cover 244 is shown as having a depression 262 which can hold food and which then is covered by a lid film.

In the above drawings, the cup lower portion such as 30 in FIG. 1 is primarily cylindrical while the cup upper portion 32 is primarily square and forms a platform 232. The primarily cylindrical cup portion is useful to insert the cup lower portion into a vehicle cup holder of the type that lies beside the driver, with the lower surface 234 of the platform lying on a surface that surrounds the cup-receiving hole. The cup upper portion can have a variety of shapes including the largely rectangular shape shown, a round shape and a polygonal shape.

Thus, the invention provides a container system that can be formed of a single piece of sheet plastic that forms a cup, a cover, and at least one container that lies in the cup upper portion under the cover. The cup, cover and container each has a flange, and the flanges are connected together along joining regions that form tearable pivot lines. The container system is initially formed with the cover and container in open positions away from the cup top. A clerk in a store loads food into the cup and container and then pivots the container into the cup upper portion and finally pivots the cover closed over the stowed container and into the cup top. A person cannot open the system to sample any of the food without first tearing off the cover from the cup along the pivot line that connects them. The container then can be opened while in the cup or after pivoting the container out of the cup and then tearing the container away along its pivot line.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A plastic food packaging system which includes a cup with upper and lower portions and with a cup top that has a periphery, said packaging system including a cover, said cup and cover each made of a polymer material, wherein said cover is moveable to a closed position to cover said cup top and is moveable to an open position to uncover said cup top, wherein:

said packaging system includes at least one container moveable into said cup upper portion to lie below said cover when said cover is in said cover closed position;

said cover having a cover region pivotally connected to said cup top periphery about a first horizontal axis, and said at least one container having a container periphery pivotally connected to said cup top periphery about a different second horizontal axis;

the cover closes the at least one container to form at least one container cavity when the at least one container is in the cup upper portion and the cover is in the cover closed position;

said cup, said cover, and said at least one container are all formed from a single sheet of sheet plastic; and said sheet of plastic forms a first tear line that extends along said first axis and forms at least one cover lift tab for tearing the cover apart from said cup along said first tear line, and said sheet of plastic forms a second tear line that extends along said second axis and forms at least one lift tab for tearing the at least one container apart from said cup along said second tear line.

2. The system described in claim 1 wherein:

said cup has a vertical axis and said cup has a radially outward and primarily horizontal cup flange at the cup top, said sheet of plastic comprising at least one interrupted upward projection that projects above said cup flange;

said cover has a cover flange with a radially outward edge that lies substantially against a radially inward side of said upward projection.

3. The system described in claim 1 wherein said at least one container has a vertical axis, and wherein:

said cup upper portion has a cup sealing surface lying below a level defined by said cup top periphery;

said container has lower and upper portions with said upper portion forming a container sealing wall part with an outer surface lying against an inside sealing surface of said cup sealing wall and with an inside surface;

said cover has a peripheral portion with a cover sealing surface that lies against said inside surface of said container sealing wall part;

as seen in section view that includes said cup axis, said sealing surfaces of said container, cover, and cup are curved about a point that lies on said cup axis.

4. The system described in claim 1, wherein the at least one container closes the cup to form a cup lower portion cavity when the at least one container is in a container closed position.

5. The system described in claim 1, wherein the at least one container comprises an inner container sealing wall forming an interference fit with a cover sealing surface when the cover is in the cover closed position.

6. A plastic food packaging system which includes a cup with upper and lower portions and with a cup top that has a periphery, said packaging system including a cover, said cup and cover each made of a polymer material, wherein said cover is moveable to a closed position to cover said cup top and is moveable to an open position to uncover said cup top, wherein:

said packaging system includes at least one container moveable into said cup upper portion to lie below said cover when said cover is in said cover closed position;

said cover having a cover region pivotally connected to said cup top periphery about a first horizontal axis, and said at least one container having a container periphery pivotally connected to said cup top periphery about a different second horizontal axis;

the cover closes the at least one container to form at least one container cavity when the at least one container is in the cup upper portion and the cover is in the cover closed position;

said cup, cover and at least one container are all formed from a single sheet of plastic;

said cup has a vertical axis and said cup has a radially outward and primarily horizontal cup flange at the cup top, said sheet of plastic comprising at least one interrupted upward projection that projects above said cup flange;

said cover has a cover flange with a radially outer edge that lies substantially against a radially inward side of said upward projection; and said upward projection has radially inward sides that are upwardly undercut to resist lifting said cup flange.

7. The system described in claim 6, wherein the at least one container closes the cup to form a cup lower portion cavity when the at least one container is in a container closed position.

8. The system described in claim 6, wherein the at least one container comprises an inner container sealing wall forming an interference fit with a cover sealing surface when the cover is in the cover closed position.

9. The system described in claim 6, wherein:

said cup and cover have flange portions that lie at a first height, and said cup and container have flange portions that lie at a second height wherein said second height is below said first height.

10. A plastic food packaging system which includes a cup with upper and lower portions and with a cup top that has a periphery, said packaging system including a cover, said cup and cover each made of a polymer material, wherein said cover is moveable to a closed position to cover said cup top and is moveable to an open position to uncover said cup top, wherein:

said packaging system includes at least one container moveable into said cup upper portion to lie below said cover when said cover is in said cover closed position;

said cover having a cover region pivotally connected to said cup top periphery about a first horizontal axis, and said at least one container having a container periphery pivotally connected to said cup top periphery about a different second horizontal axis;

the cover closes the at least one container to form at least one container cavity when the at least one container is in the cup upper portion and the cover is in the cover closed position, said cup, cover and at least one container are all formed from a single sheet of plastic;

said cup has a vertical axis and said cup has a radially outward and primarily horizontal cup flange at the cup top, said sheet of plastic comprising at least one interrupted upward projection that projects above said cup flange;

said cover has a cover flange with a radially outer edge that lies substantially against a radially inward side of said upward projection; and said upward projection includes at least one upward projection in said at least one container adjacent to said second horizontal axis, and a plurality of upward projections in said cup.

11. The system described in claim 10, wherein the at least one container closes the cup to form a cup lower portion cavity when the container is in a container closed position.

12. The system described in claim 10, wherein the at least one container comprises an inner container sealing wall forming an interference fit with a cover sealing surface when the cover is in the cover closed position.

13. A plastic food packaging system which includes a cup that has a vertical axis and upper and lower portions with said upper portion having a cup top, and which includes a cover moveable between open and closed positions on said cup top, including:

a container moveable between a first position in said cup and a second position out of said cup, when said cover lies in said open position;

said cup top having an outward cup flange, said cover having an outward cover flange, and said container having a container flange and a container storage portion with a height of at least one centimeter; and means for coupling said cup flange to said cover flange and means for coupling said container flange to said cup flange, wherein the cover closes the container storage portion to form a container cavity when the container is in the first position and the cover is in the closed position, and wherein said cup, said cover, and said container are all formed of a single sheet of plastic, and said means for coupling said cup flange to said cover flange and to said container flange includes a joint region of said sheet that forms a horizontal pivot-tear line about which said container flange can pivot about a horizontal axis on said cup flange, said pivot-tear line being a line of weakness that can be torn to separate said container from said cup.

14. The system described in claim 13 wherein the container closes the cup to form a cup lower portion cavity when the container is in the first position.

15. The system described in claim 13, wherein the container comprises an inner container sealing wall forming an interference fit with a cover sealing surface when the cover is in the cover closed position.

16. A plastic food packaging system which includes a cup that has a vertical axis and upper and lower portions with said upper portion having a cup top, and which includes a cover moveable between open and closed positions on said cup top, including:

a container moveable between a first position in said cup and a second position out of said cup, when said cover lies in said open position;

said cup top having an outward cup flange, said cover having an outward cover flange, and said container having a container flange and a container storage portion with a height of at least one centimeter; and means for coupling said cup flange to said cover flange and means for coupling said container flange to said cup flange, wherein:

the cover closes the container storage portion to form a container cavity when the container is in the first position and the cover is in the closed position;

said cup and said cover are formed of a single sheet of plastic;

said means for coupling said container flange to said cup flange includes portions of said cup and cover flanges that are integral with a pivot line between them; and said container flange has a radially projecting portion forming a tab that lies in under said cover in the closed cover position, and that can be lifted to remove the container from the cup.

17. The system described in claim 16, wherein the at least one container closes the cup to form a cup lower portion cavity when the container is in the first position.

18. The system described in claim 16, wherein the container comprises an inner container sealing wall forming an interference fit with a cover sealing surface when the cover is in the cover closed position.

19. A plastic food container comprising a cup with a vertical axis and with lower and upper cup portions and a cup flange at a top of the cup, and a cover pivotally connected about a tearable horizontal axis to a first side of said cup flange, the cover pivotable between a closed position and an open position, including:

a container that has a storage portion that lies in said upper cup portion and a container flange that projects radially outward from a top of said container, wherein the cover encloses the storage portion to form a container cavity when in the closed position; and said first side of said cup flange having a cup flange part and said container flange has a radially outward projection that forms a lift tab that lies on said cup flange part and under said cover flange to form a gap between the cup flange part and the cover flange when the cover has been torn free from said axis and then replaced on said cup.

20. The system described in claim 19, wherein the container closes the cup to form a cup lower portion cavity when the container is in a container closed position.

21. The system described in claim 19, wherein the container comprises an inner container scaling wall forming an interference fit with a cover sealing surface when the cover is in the cover closed position.

22. The system described in claim 19 wherein:

said upper cup portion has a cup internal seal, and said cover has an external seal that lies in said cup upper portion and seals to said cup seal when said over is in the closed position on said cup;

said cup flange has an interrupted upward projection that projects above said cover flange when said cover is closed on said cup, said upward projection preventing access to a radially outward edge of said cover when said cover is in the closed position on said cup.

* * * * *